United States Patent [19]

Wojtanek

[11] Patent Number: 4,536,626

[45] Date of Patent: Aug. 20, 1985

[54] TIMER DRIVE MECHANISM

[75] Inventor: Guy A. Wojtanek, Franklin Park, Ill.

[73] Assignee: The Singer Company, Stamford, Conn.

[21] Appl. No.: 616,092

[22] Filed: Jun. 1, 1984

[51] Int. Cl.[3] ..... H01H 43/00; G04F 8/00

[52] U.S. Cl. ..... 200/35 R; 200/38 B; 368/108

[58] Field of Search ..... 74/118, 125, 128, 142, 74/160, 567, 568 T, 575, 578; 200/35 R, 38 R, 38 B, 38 BA, 38 C, 38 CA; 368/108, 109

[56] References Cited

U.S. PATENT DOCUMENTS

| | | | |
|---|---|---|---|
| 2,868,026 | 1/1959 | Finehout et al. | 74/125 |
| 2,900,840 | 8/1959 | Greve | 74/575 |
| 3,064,891 | 11/1962 | Nicolaus | 235/117 R |
| 3,857,293 | 12/1974 | Godwin et al. | 74/118 |

*Primary Examiner*—J. R. Scott

*Attorney, Agent, or Firm*—David L. Davis; Robert E. Smith; Edward L. Bell

[57] ABSTRACT

A drive mechanism for a timer includes a drive pawl having a pin which is trapped between two camming surfaces of a continuously driven drive cam. The drive pawl is slidably mounted in the timer frame so that it is linearly reciprocated when the drive cam is rotated. A spring biases the drive pawl against the ratchet track.

9 Claims, 11 Drawing Figures

TIMER DRIVE MECHANISM

BACKGROUND OF THE INVENTION

This invention relates to timers of the type advanced in a step-by-step manner by a drive mechanism and, more particularly, to the drive mechanism itself.

When designing a drive mechanism for a switching device in a program timer, a number of criteria must be taken into consideration. For example, it is desirable to advance the switching device at a relatively rapid rate for fast switching action. Prior designs have resulted in an indexing mechanism which drives the switching device in a step-by-step manner by providing a ratchet track on the switching device and a drive pawl which cooperates with the ratchet track to index the switching device. However, these designs have not proven to be entirely satisfactory for a number of reasons. For example, the movement profile of the drive pawl has generally been limited to a sinusoidal motion. Also, these mechanisms have required a relatively large number of parts, increasing the cost of production.

It is therefore an object of this invention to provide a drive mechanism for advancing the switching device in a program timer in a step-by-step manner wherein the movement profile of the drive pawl can be tailored as desired.

It is another object of this invention to provide such a mechanism which comprises a relatively small number of parts.

SUMMARY OF THE INVENTION

The foregoing and additional objects are attained in accordance with the principles of this invention by providing a drive mechanism for a program timer which includes a drive pawl having a cam follower which is trapped between two camming surfaces of a continuously driven drive cam. The drive pawl is yieldably biased against the ratchet track of the switching device and is guided for substantially linear reciprocation tangentially to the ratchet track.

In accordance with an aspect of this invention, the drive cam comprises a disc having a channel formed in one of its faces, with the first wall of the channel forming the first camming surface and the second wall of the channel forming the second camming surface.

BRIEF DESCRIPTION OF THE DRAWINGS

The foregoing will be more readily apparent upon reading the following description in conjunction with the drawings in which like elements in different figures thereof have the same reference character applied thereto and wherein.

DETAILED DESCRIPTION

Figure 1:
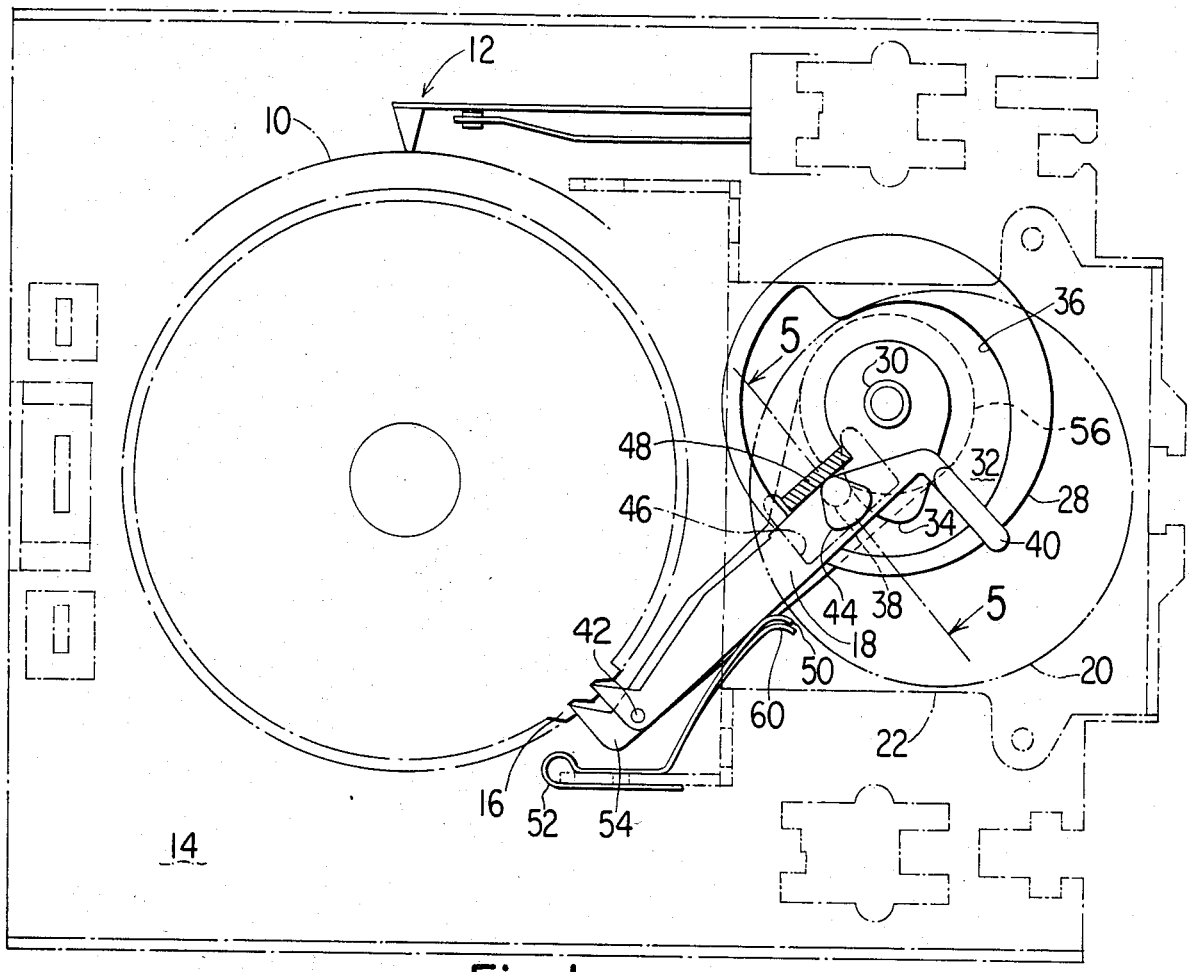
FIG. 1 is a plan view through the front plate of a program timer showing the drive mechanism according to this invention.

FIG. 1 shows the relevant portions of a program timer necessary for an understanding of the present invention. Thus, as is well known, the program timer includes a plurality of timing cams 10 located on a rotating member for controlling the operation of switches 12 in a predetermined program. In particular, the rotating member is a hollow cam drum, sometimes referred to as a monoblock, which is rotatably journalled between a rear plate (not shown) and a front plate 14, shown in phantom. The details of the monoblock with respect to the timing cams 10 and the switches 12 are well known in the art and form no part of the present invention.

The present invention is concerned with the mechanism for driving the monoblock. Accordingly, there is provided a ratchet track 16 on the monoblock. A drive pawl 18 is operatively associated with the ratchet track 16 to drive the monoblock in a step-by-step manner, as will become clear from the following discussion.

The drive power source is a motor 20 mounted on a motor frame 22 secured to the front plate. As is conventional, the motor 20 is a reduction motor having an output shaft. The output shaft of the motor 20 fits into an opening 24 provided therefor in a boss 26 formed on a drive cam 28. The other side of the drive cam 28 is formed with a stub shaft 30 which is journalled for rotation in a suitable opening provided in the front plate. Accordingly, the motor 20 rotates the drive cam 28 in a clockwise direction, as viewed in FIG. 1.

Figure 3:
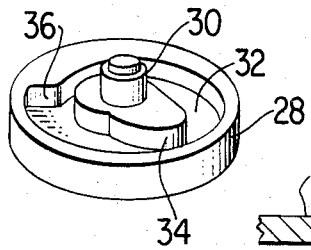
FIG. 3 is a perspective view of a drive cam constructed in accordance with this invention.

As may be clearly seen from FIG. 3, the drive cam 28 comprises a disc having a channel 32 formed in one face thereof. The channel 32 forms a closed path surrounding the center of rotation of the drive cam 28 and has a first, or inner, wall 34 and a second, or outer, wall 36. The inner wall 34 forms a first camming surface for the drive pawl 18 and the outer wall 36 forms a second camming surface for the drive pawl 18.

Figure 4:
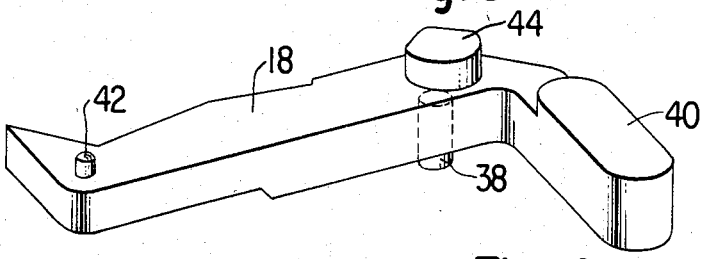
FIG. 4 is a perspective view of a drive pawl constructed in accordance with this invention.
Figure 2:
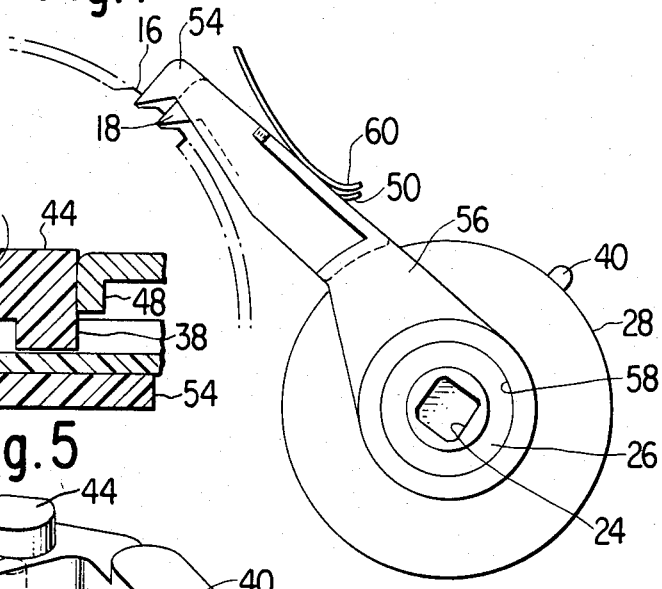
FIG. 2 is a plan view showing the underside of the drive cam of the drive mechanism shown in FIG. 1.
Figure 6A:
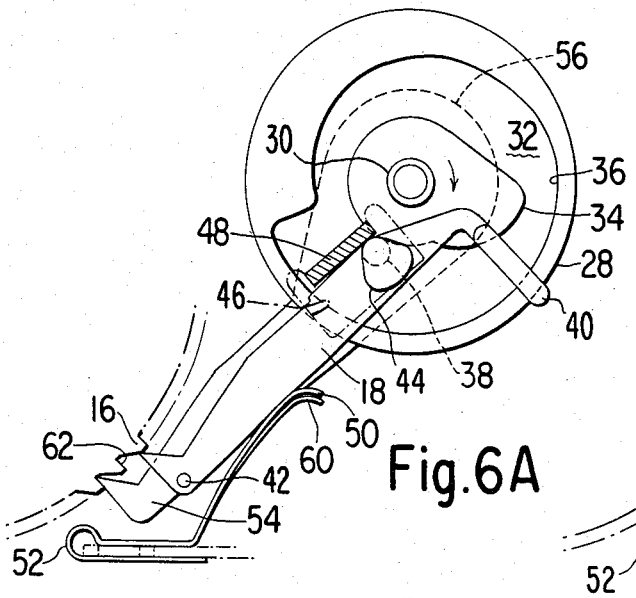
FIGS. 6A–6F show the sequence of operation of the drive mechanism according to this invention.
Figure 6B:
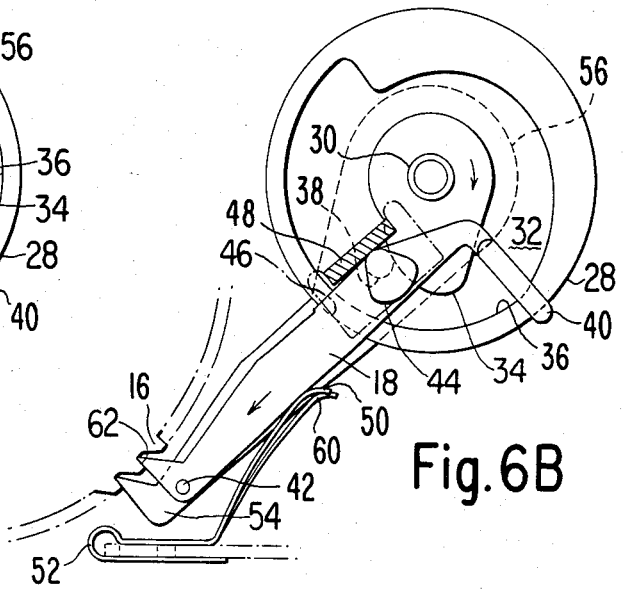
Figure 6C:
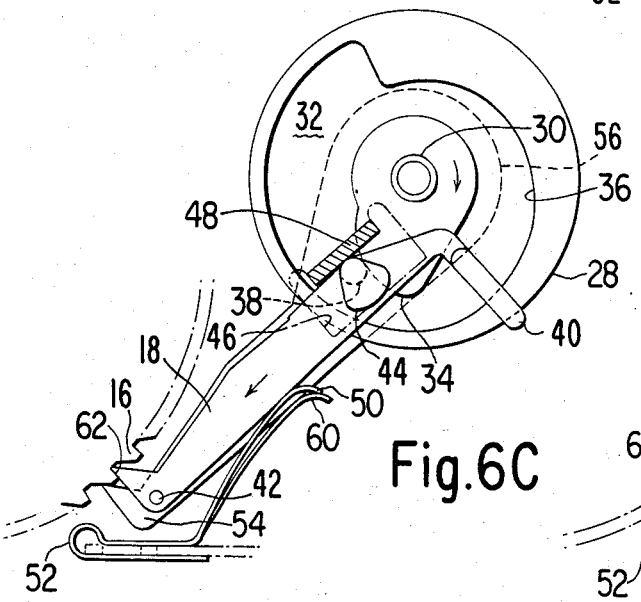
Figure 6D:
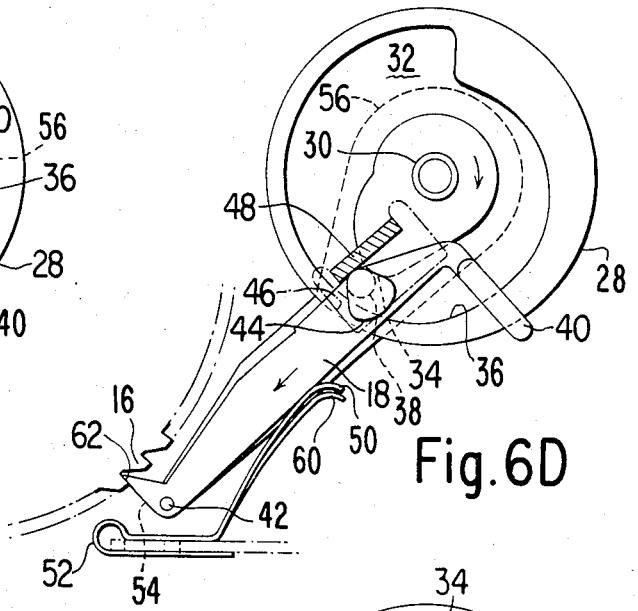
Figure 6E:
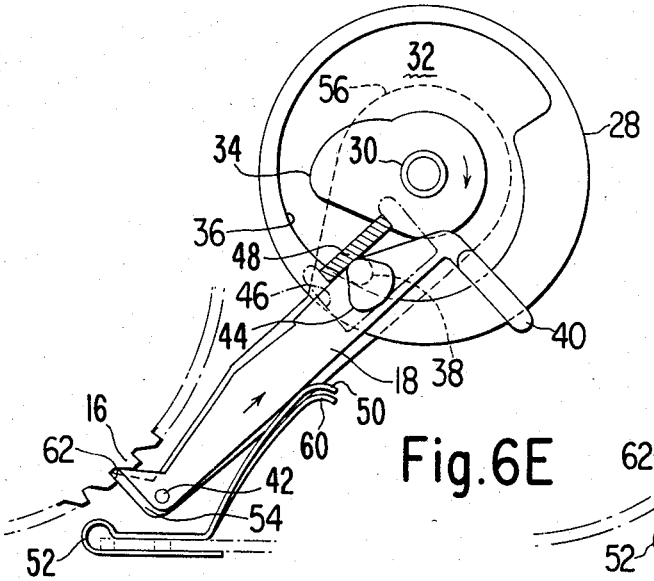
Figure 6F:
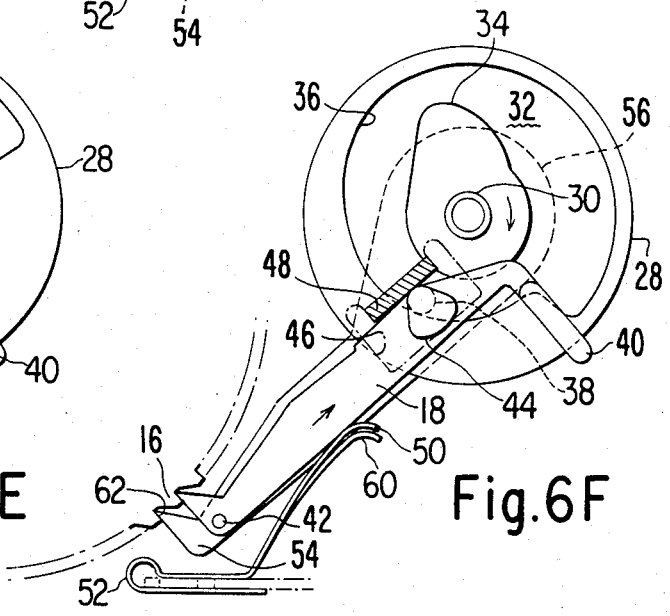

As is clearly shown in FIG. 4, the drive pawl 18 is formed with a pin 38 which extends transversely to the direction of reciprocation of the drive pawl 18, which direction of reciprocation is along the major longitudinal axis of the drive pawl 18. The pin 38 acts as a cam follower and is adapted to extend into the channel 32 between the walls 34 and 36. The drive pawl 18 is further formed with a tail section 40 which extends beyond the pin 38, the tail section 40 being of sufficient dimension so that it always spans the channel 32, irrespective of the rotative angle of the drive cam 28. This insures that an end of the drive pawl 18 does not get jammed against one of the walls 34, 36. It will be noted from FIG. 4 that the thickness of most of the tail section 40 is greater than the thickness of the remainder of the drive pawl 18. This allows the tail section 40 to provide a sliding bearing surface between the "land" areas of the drive cam 28 and the front plate. Additionally, the driving end of the drive pawl 18 is formed with a small stub 42 which provides another bearing surface against the front plate of the timer.

Figure 5:
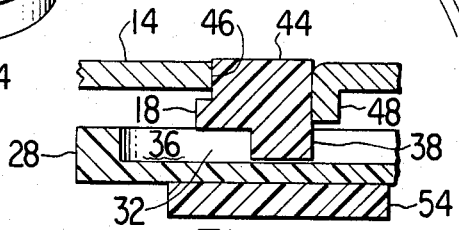
FIG. 5 is a detailed cross-sectional view taken along the line 5—5 in FIG. 1.

The drive pawl 18 is further formed with a guide pin 44 on the opposite side of the drive pawl 18 from the cam follower pin 38. As shown in FIG. 5, the guide pin 44 cooperates with an elongated slot 46 formed in the front plate 14 and a depending tab 48 formed from the front plate material cut away when the slot 46 was formed to keep the drive pawl 18 reciprocating in a linear direction substantially parallel to its major longitudinal axis. The size of the guide pin 44 in the direction transverse to the direction of reciprocation of the drive pawl 18 is substantially the same as the width of the slot 46. A leaf spring 50 which is folded at 52 to be held by a portion of the motor frame 22 is cantilevered away from the motor frame 22 and toward the ratchet track 16 so as to yieldably bias the drive pawl 18 against the ratchet track 16.

As is typical with a program timer, some means must be provided for preventing the monoblock from rotating in a direction opposite from that in which it is driven by the drive pawl 18. Accordingly, an anti-reverse, or stop, pawl 54 is provided. The anti-reverse pawl 54 is formed with an enlarged extension 56 having an opening 58 encircling the boss 26 to be carried thereby. The anti-reverse pawl 54 is yieldably biased against the ratchet track 16 by means of a leaf spring 60 which, like the spring 50, is cantilevered away from the motor frame 22 and toward the ratchet track 16. Illustratively, the springs 50 and 60 are separate fingers of a bifurcated unitary spring assembly. Alternatively, each of the pawls 18 and 54 may be formed with an integrally molded cantilever spring. These molded springs would bear against a bent tab formed from the front plate.

FIGS. 6A–6F show the sequence of operation of the illustrated drive mechanism. As viewed therein, the drive cam 28 rotates in the clockwise direction. In the angular orientation shown in FIG. 6A, the drive pawl 18 is in an undriven state because the cam follower pin 38 is between a constant radius portion of the inner wall 34 and a constant radius portion of the outer wall 36 of the channel 32 of the drive cam 28. In the angular orientation depicted in FIG. 6B, the drive pawl 54 is moved outwardly, as shown by the arrow thereon, from the center of rotation of the drive cam 28 because the cam follower pin 38 is against a portion of the inner wall 34 having an increasing radius. The driving end of the pawl 18 therefore moves against a wall 62 of a tooth on the ratchet track 16. In the position depicted in FIG. 6C, the drive pawl 18 has been moved further out due to the increasing radius of the inner wall 34 which bears against the cam follower pin 38 so as to move the monoblock in a clockwise direction. At this time, the anti-reverse pawl 54 slides out of the tooth notch where it has previously been. In the angular orientation depicted in FIG. 6D, the cam follower pin 38 is against that portion of the inner wall 34 having the greatest radius so that the drive pawl 18 is at its greatest extent of travel. At this time, the anti-reverse pawl 54 drops into the same tooth notch occupied by the drive pawl 18 and bears against the wall 62 to prevent reverse movement of the monoblock. In the angular position depicted in FIG. 6E, the cam follower pin 38 comes under the influence of the outer wall 36 which is now in a region of decreasing radius. The drive pawl 18 is therefore pulled inwardly, as depicted by the arrow thereon, by the inner wall 36. In the angular position depicted in FIG. 6F, the cam follower pin 38 is still under the influence of the outer wall 36 and is almost to the end of the region of decreasing radius and has retracted sufficiently to engage the following tooth of the ratchet track 62 for its next drive stroke.

Thus, the contour of the inner wall 34 controls the driving portion of the stroke of the pawl 18 and the contour of the outer wall 36 controls the return portion of the stroke of the pawl 18. This arrangement possesses a number of advantages. For example, there are relatively few parts to this drive mechanism, thereby lowering the cost to produce it. Another advantage is that the drive pawl 18 is positively driven by cam surfaces throughout its entire stroke. Since these cam surfaces can take on almost any contour, the motion of the drive pawl 18 is not restricted to a particular type (i.e., sinusoidal). Therefore, virtually any ratio of impulse to interval time can be achieved which allow for tighter switch sequencing with respect to time (shorter impulse) while conserving angular movement of the cam assembly (longer dwell or interval time). Further, the same drive mechanism can be utilized for different applications by merely replacing the drive cam 28 with one having a more appropriate configuration of the walls 34 and 36. Additionally, since the motion of the drive pawl 18 more closely follows a straight line tangent to the ratchet track, different choices are available to the designer for a spring to bias the drive and anti-reverse pawls against the ratchet track, as discussed above.

An alternative construction to the one described above would be to have the drive cam 28 rotate in a counterclockwise direction and bias the pin 38 against the other side of the slot 46.

Accordingly, there has been disclosed a drive mechanism for a timer. It is understood that the above-described embodiment is merely illustrative of the application of the principles of this invention. Numerous other embodiments may be devised by those skilled in the art without departing from the spirit and scope of this invention, as defined by the appended claims.

I claim:

1. A mechanism for driving a switching device in a timer or the like in a step-by-step manner, comprising:

a ratchet track on said switching device;

a motor;

a drive cam coupled to said motor for continuous rotation therewith, said drive cam having opposed first and second camming surfaces thereon;

a drive pawl operatively associated with said ratchet track;

a cam follower mounted on said drive pawl and trapped between said first and second camming surfaces;

means for yieldably biasing said drive pawl against said ratchet track; and guide means for limiting the motion of said drive pawl to substantially linear reciprocation tangential to said ratchet track.

2. The mechanism according to claim 1 wherein said drive cam comprises a disc having a channel formed in one face thereof, a first wall of said channel forming said first camming surface and a second wall of said channel forming said second camming surface.

3. The mechanism according to claim 2 wherein said channel forms a closed path surrounding the center of rotation of said disc.

4. The mechanism according to claim 3 wherein the contour of the inner wall of said channel defines the drive stroke of said drive pawl and the contour of the outer wall of said channel defines the return stroke of said drive pawl.

5. The mechanism according to claim 4 wherein said cam follower comprises a pin extending from said drive pawl transversely to the direction of reciprocation of said drive pawl.

6. The mechanism according to claim 5 wherein said drive pawl is formed with a tail section extending beyond said pin, said tail section being of sufficient dimension to span said channel throughout the entire rotation of said drive cam.

7. The mechanism according to claim 1 wherein said drive cam is formed with a circular boss concentric with the center of rotation of said drive cam, said mechanism further comprising:

an anti-reverse pawl cooperating with said ratchet track to prevent movement thereof in a direction opposite to that imparted thereto by said drive pawl, said anti-reverse pawl being formed with an opening encircling said boss to be carried thereby; and means for yieldably biasing said anti-reverse pawl against said ratchet track.

8. The mechanism according to claim 1 wherein said timer includes a plate and said guide means comprises:

an open elongated slot in said plate; and a pin mounted on said drive pawl and extending through said slot, the dimension of said pin in the direction transverse to the direction of reciprocation of said drive pawl being substantially the same as the width of said slot.

9. The mechanism according to claim 1 wherein said biasing means includes a leaf spring.

* * * * *